United States Patent [19]

Woodward et al.

[11] Patent Number: 4,960,184

[45] Date of Patent: Oct. 2, 1990

[54] SOUND ABSORBING STRUCTURE

[76] Inventors: Bruce Woodward, 1408 Walnut La., Anchorage, Ky. 40223; William Miller, R.R. 1, Box 248, Borden, Ind. 47106

[21] Appl. No.: 433,951

[22] Filed: Nov. 9, 1989

[51] Int. Cl.[5] ..... E04B 1/82; E04B 1/343

[52] U.S. Cl. ..... 181/287; 181/290; 181/294; 52/144

[58] Field of Search ..... 181/284, 285, 287, 290, 181/293, 295, 202, 208, 294; 52/144, 145

[56] References Cited

U.S. PATENT DOCUMENTS

| | | | |
|---|---|---|---|
| 3,967,693 | 7/1976 | Okawa | 181/284 |
| 4,258,821 | 3/1981 | Wendt et al. | 181/202 |
| 4,441,580 | 4/1984 | Webster | 181/290 X |
| 4,778,028 | 10/1988 | Staley | 181/208 |
| 4,829,728 | 5/1989 | Castell | 181/295 X |
| 4,842,097 | 6/1989 | Woodward et al. | 181/290 X |

*Primary Examiner*—Benjamin R. Fuller
*Attorney, Agent, or Firm*—Charles G. Lamb

[57] ABSTRACT

A sound absorbing panel structure is formed of a panel of sound absorbing material, such as a felt mat or fiberglass mat, and spaced apart, parallel strips of a decorative non-sound absorbing material attached to one side surface of the sound absorbing panel so that the sound absorbing panel is exposed in the area between the adjacent strips of decorative material.

10 Claims, 1 Drawing Sheet

SOUND ABSORBING STRUCTURE

BACKGROUND OF THE INVENTION

1. Field of the Invention.

This invention relates to sound absorbing panel structures, and more particularly to a sound absorbing panel structure which can be applied over a wall or ceiling surface to provide effective sound absorption and at the same time provide a durable decorative appearance.

2. Prior Art.

Acoustical panels to be applied over wall or ceiling surfaces to absorb sound are per se known. They are often used in commercial structures such as airports, lobbies, restaurant, and the like to dampen the noise. Such panels known to us consists solely of a sound absorbing material such as fiberglass mat. Attempts to make these fiberglass panels decorative in appearance have been directed to forming a pattern in the face of the fiberglass panel which will be exposed when installed on the wall or ceiling surface, and possibly coloring the exposed surface. Even then, it is obvious to even a casual observer that the panel is fabricated of a fiberglass material which lacks aesthetic good looks. In addition, the known fiberglass or other types of acoustical panels have a soft exposed surface which can be easily dented, chipped, or otherwise damaged or destroyed. It is also known to cover the front or exposed surface of a sound absorbing panel with a fabric or cloth to hide the underlying panel. However, the layer of cloth does not protect the panel from damage. Further, the cloth is readily soiled which destroys the appearance of the panel. This is a particular drawback when the acoustical panels are used to cover walls because walls or especially subject to even inadvertent damage.

The present invention provides an acoustical sound absorbing panel structure which has a decorative surface which will be exposed when installed on a wall or ceiling which disguises the sound absorbing panel material of the panel.

Furthermore, the present invention provides an acoustical sound absorbing panel structure not readily subject to damage and protects the sound absorbing panel material from the damage discussed above.

SUMMARY OF THE INVENTION

It has been found that a sound absorbing panel for walls and ceilings can be made which is aesthetically appealing. It has also been found that non-sound absorbing strips covering a large surface area of the face of a sound absorbing panel can be spaced so that the sound absorbency of the completed panel is not appreciably reduced. More particularly, the present invention provides an acoustical sound absorbing panel structure to be applied in overlaying relationship to a wall or ceiling of an enclosure, such as a room in a building comprising a panel of sound absorbing material having a face and back side and a plurality of spaced strips of a non-sound absorbing material attached to the face side surface of the sound absorbing panel, the face side surface being exposed when the panel structure is applied to the wall or ceiling surface whereby the sound absorbing material in the panel is exposed in the area between said adjacent strips.

BRIEF DESCRIPTION OF THE DRAWINGS

A better understanding of the present invention will be had upon reference to the following description in conjunction with the accompanying drawings wherein like numerals refer to like parts throughout the several views and in which.

DETAILED DESCRIPTION OF THE PREFERRED EMBODIMENT

Figure 1:
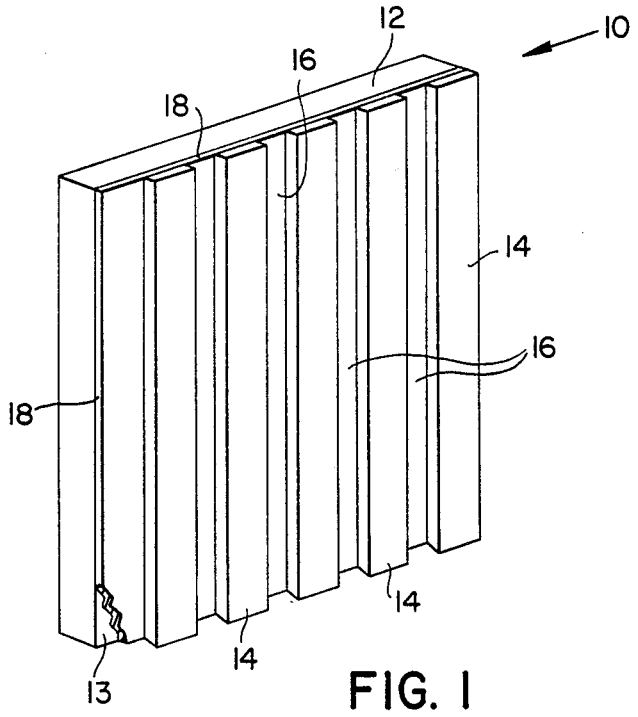
FIG. 1 is a perspective view of an acoustical panel structure of the present invention with selected portions cut-away; and, FIG. 2 is an enlarged perspective view of a component of the acoustical panel structure of FIG. 1.

With reference to FIG. 1, there is shown a perceptive view of the acoustical panel structure 10 of the present invention which is to be placed in overlaying relationship to a wall or ceiling surface of, for example, a room to provide sound absorption. The acoustical panel structure 10 can be secured to the underlying wall or ceiling surface by various means, such as an adhesive.

With continued reference to FIG. 1, the acoustical panel structure 10 comprises a panel 12 of sound absorbing material. Various suitable sound absorbing materials include, for example, a felt mat or fiberglass mat, or the like. A plurality of strips 14 of non-sound absorbing material are secured to the face 13 of the panel 12 in spaced apart parallel relationship to each other such that the sound absorbing material of the panel 12 is exposed in the space 16 between adjacent strips 14. These strips 14 can be secured or attached to the panel 12 by various means known in the art, such as, for example, an adhesive. The face surface of the panel structure 10 having the strips 14 will be the exterior or exposed side of the panel structure 10 when it is installed on an enclosure wall or ceiling surface.

In the embodiment of FIG. 1, an intermediate layer 18 of a fire-retardant material, such as an open weave cloth treated with a fire retardant, overlays and is attached to the face 13 of the panel 12, and the strips 14 are attached to the layer 18. The layer 18 is fabricated of an open weave material so as to have a minimum effect on the sound absorbing properties of the sound absorbing panel 12.

Figure 2:
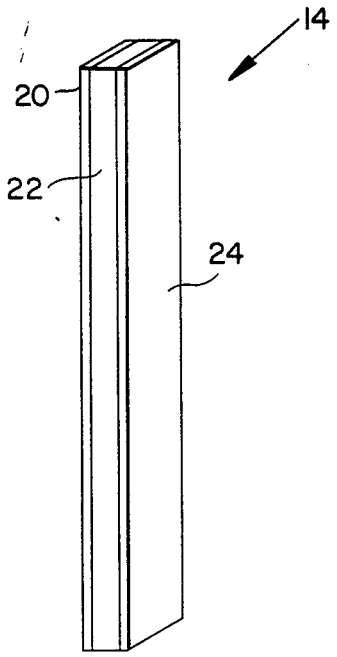

Now with reference to FIG. 2, there is shown a single strip 14 more clearly showing the details of its construction. The strip 14 is a laminated structure consisting of a back layer 20, an intermediate layer 22, and a face layer 24. The back layer 20 can be fabricated of any known material in the art, such as, a wood veneer, the intermediate layer 22 can be, for example, a hardwood, and the front layer can be a wood veneer, metal, hardboard, high pressure laminate, or the like.

The strips are sized to cover no more than 80% of the surface area of the face side surface of the panel structure 12 upon which they are attached while providing a noise reduction coefficient of no less than .75.

A panel structure 10 of the present invention was tested in accordance with the American Society for Testing and Materials Standard (ANSI/ASTM C423-81a and E795) for sound absorption coefficients by the reverberation room in width, 47.75 inches in height, and 1.375 inches in thickness. The strips 14 measured 1.90 inches in width, 47.75 inches in height, and 0.1875 inches thick, and were spaced apart from each other by 0.43 inches. Therefore, the total area of the face surface of the sound absorbing panel 12 covered by the strips 14 was 907.25 square inches or 79.5% of the free surface of the sound absorbing panel 12.

The test results are shown in Table 1, below.

REVERBERATION ROOM SOUND ABSORPTION TEST

| ⅓ OCTAVE CENTER CENTER FREQUENCY (Hz) | ABSORPTION COEF-FICIENT | | TOTAL ABSORP-TION IN SABINS | % OF UNCERT. WITH 95% CONF. LIMIT FOR THE ABSOR. OF THE REV. RM. WITH THE SPECIMEN |
|---|---|---|---|---|
| 100.00 | .38380 | .38 | 27.63 | .57 |
| ** 125.00 | .33773 | .34 | 24.32 | .62 |
| 160.00 | .27880 | .28 | 20.07 | .72 |
| 200.00 | .38875 | .39 | 27.99 | .63 |
| ** 250.00 | .51028 | .51 | 36.74 | .61 |
| 315.00 | .73999 | .74 | 53.28 | .66 |
| 400.00 | .88801 | .89 | 63.94 | .60 |
| ** 500.00 | 1.04951 | 1.05 | 75.56 | .57 |
| 630.00 | 1.10574 | 1.11 | 79.61 | .56 |
| 800.00 | 1.02282 | 1.02 | 73.64 | .58 |
| ** 1000.00 | .97715 | .98 | 70.35 | .62 |
| 1250.00 | .90796 | .91 | 65.37 | .65 |
| 1600.00 | .81289 | .81 | 58.53 | .68 |
| ** 2000.00 | .74422 | .74 | 53.58 | .70 |
| 2500.00 | .67405 | .67 | 48.53 | .69 |
| 3150.00 | .57033 | .57 | 41.06 | .72 |
| ** 4000.00 | .56118 | .56 | 40.40 | .60 |
| 5000.00 | .54678 | .55 | 39.37 | .55 |
| | | NRC = .8 | | |

THE PERCENTAGE OF UNCERTAINTY FOR THE REQUIRED 95% CONFIDENCE LIMITS INDICATED ABOVE MUST FALL WITHIN THE PRESCRIBED LIMITS DESIGNATED IN PAR.13.2 OF ASTM C423-81a. IT STATES THAT THE TESTING LABORATORY SHALL OBTAIN DATA WITH LESS THAN 4% UNCERTAINTY AT 125 Hz AND 2% UNCERTAINTY AT 250, 500, 1000, 2000 AND 4000 Hz. THE METHOD OF CALCULATION IS DESCRIBED IN ASTM STP 15D AND OUTLINED IN SECTION 13 OF THE STANDARD.
THE NOISE REDUCTION COEFFICIENT (NRC) IS THE AVERAGE OF THE COEFFICIENTS AT 250, 500, 1000, AND 2000 Hz, EXPRESSED TO NEAREST INTERGAL MULTIPLE OF 0.05.

It would have been expected that by covering 80% of the face surface of the sound absorbing panel 12 that a much greater reduction in the noise reduction coefficient would have resulted. While the strips 14 of the panel structure 10 do reduce the coefficient of noise reduction somewhat, the panel structure 10 still provides a coefficient of noise reduction which is well within the acceptable range for most applications.

In use, the strips 14 generally cover from about 50% to 80% of the face surface of the sound absorbing panel 12. The acoustical sound absorbing panel structure 10 can be laid directly over a wall or ceiling surface of an enclosure, and can be attached to the wall/ceiling surface by various means such as an adhesive or by mechanical means well known in the art. In addition, because of the flexibility of the sound absorbing panel 12, and with the strips 14 oriented vertically, the panel structure 10 can be used to overlay a curved wall/ceiling surface.

The strips 14 overlaying the front surface of the panel 12 obscures or disguises the sound absorbing panel 12 so that it does not appear to an observer that the panel structure 10 is a sound absorbing structure. In addition, the strips 14 protruding from the front surface of the panel 12 protects the front surface of the panel 12 from damage by being dented, chipped, and the like. Because the strips 14 are themselves fabricated of a relatively hard material, they are much more resistant to such damage than is the material of the panel 12 so that the panel structure 10 of the present invention provides for longer life than prior known sound absorbing panel structures.

The foregoing detailed description is given primarily for clearness of understanding and no unnecessary limitations are to be understood therefrom for modifications will become obvious to those skilled in the art upon reading this disclosure and may be made without departing from the scope of the appended claims.

What is claimed:

1. An acoustical sound absorbing panel structure to be applied in overlaying relationship to a wall or ceiling surface comprising:

a panel of sound absorbing materials having a face and back surface; and, a plurality of spaced apart, parallel strips of a non-sound absorbing material attached to said face surface of the sound absorbing panel, said face surface being exposed when the panel structure is applied to the wall or ceiling surface.

2. The acoustical sound absorbing panel structure of claim 1, wherein the strips are sized to cover no more than about 80% of the face surface upon which the strips are attached while providing a noise reduction coefficient of no less than .75.

3. The acoustical sound absorbing panel structure of claim 1, wherein the strips comprise:

a back layer;

an intermediate layer; and, a face layer.

4. The acoustical sound absorbing panel structure of claim 3, wherein the back layer comprises a wood veneer.

5. The acoustical sound absorbing panel structure of claim 3, wherein the intermediate layer comprises a hardwood.

6. The acoustical sound absorbing panel structure of claim 3, wherein the face layer is constructed of wood veneer.

7. The acoustical sound absorbing panel structure of claim 1 wherein said strips of sound absorbing material covers between from about 50% to 80% of the face surface of said panel of sound absorbing material.

8. The acoustical sound absorbing panel structure of claim 3, wherein the face layer is constructed of metal.

9. The acoustical sound absorbing panel structure of claim 3, wherein the face layer is constructed of hardboard.

10. The acoustical sound absorbing panel structure of claim 3, wherein the face layer is constructed of high-pressure laminate.

* * * * *